US006860200B2

(12) United States Patent
Knauer et al.

(10) Patent No.: US 6,860,200 B2
(45) Date of Patent: Mar. 1, 2005

(54) FORM CYLINDER OF A ROTARY PRINTING PRESS, IN PARTICULAR OF AN OFFSET PRINTING PRESS

(75) Inventors: Peter Knauer, Münster/Lech (DE); Klaus T. Reichel, Augsburg (DE); Josef Singler, Binswangen (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 10/670,671

(22) Filed: Sep. 25, 2003

(65) Prior Publication Data

US 2004/0139871 A1 Jul. 22, 2004

(30) Foreign Application Priority Data

Dec. 10, 2002 (DE) ..... 102 57 746

(51) Int. Cl.[7] ..... B41F 13/02; B41F 13/10

(52) U.S. Cl. ..... 101/220; 101/375; 101/376; 101/415.1

(58) Field of Search ..... 101/6, 216, 220, 101/375, 376, 378, 382.1, 383, 384, 386, 415.1

(56) References Cited

U.S. PATENT DOCUMENTS

| | | | | | |
|---|---|---|---|---|---|
| 4,711,171 | A | * | 12/1987 | Theilacker | 101/148 |
| 5,029,521 | A | * | 7/1991 | Pav et al. | 100/35 |
| 5,311,814 | A | * | 5/1994 | Kierson | 101/6 |
| 5,711,222 | A | * | 1/1998 | Taylor et al. | 101/383 |
| 5,893,210 | A | * | 4/1999 | Takei et al. | 492/47 |
| 6,038,975 | A | * | 3/2000 | Hoffmann et al. | 101/375 |
| 6,148,726 | A | * | 11/2000 | Harada | 101/217 |
| 6,283,027 | B1 | * | 9/2001 | Vrotacoe et al. | 101/376 |
| 6,286,741 | B1 | * | 9/2001 | Itoh | 226/186 |
| 6,386,100 | B1 | * | 5/2002 | Gaffney et al. | 101/376 |

FOREIGN PATENT DOCUMENTS

| | | |
|---|---|---|
| CH | 355 786 | 7/1961 |
| DE | 14 25 902 | 3/1969 |
| DE | 2 151 650 | 4/1973 |
| DE | 44 36 973 | 6/1995 |

* cited by examiner

*Primary Examiner*—Eugene H. Eickholt
(74) *Attorney, Agent, or Firm*—Cohen, Pontani, Lieberman & Pavane

(57) ABSTRACT

A form cylinder is provided with a circumferential surface which is convexly curved in the axial direction, such that the convex profile, determined by calculation, of the circumferential surface varies in such a way that the diameter of the form cylinder is largest in the axial center and smallest at the lateral edges.

5 Claims, 4 Drawing Sheets

FORM CYLINDER OF A ROTARY PRINTING PRESS, IN PARTICULAR OF AN OFFSET PRINTING PRESS

BACKGROUND OF THE INVENTION

1. Field of the Invention

The invention relates to a forme cylinder of a rotary printing press, in particular of an offset printing press.

2. Description of the Related Art

The forme cylinder can be used, in particular in offset printing, as a carrier or holding element for a printing forme which is plate-shaped and can be fixed in rounded form in axially extending clamping channels, or for a printing forme which is sleeve-shaped and can be pushed on in this form, but it is not restricted to this. Here, the printing unit can look like a conventional offset printing unit with a forme cylinder, i.e. printing-forme cylinder, as well as a blanket cylinder and an impression cylinder.

Thus, for example, DE 44 36 973 A1 describes a lithographic offset recto and verso press which has, in the printing unit, an upper and lower blanket cylinder and an upper and lower plate cylinder, which are each in rolling contact with a blanket cylinder at the printing nips.

In rotary offset presses of this type, as is known the printing image is transferred from the plate cylinder onto the blanket cylinder and from the latter onto the paper running over the impression cylinder. The ink can only be transferred, both from the plate onto the rubber blanket and also from the rubber blanket onto the paper, if a certain minimum pressure is present, what is referred to as the line pressure between the blanket cylinder and forme cylinder.

The printing-forme cylinder (i.e. the printing forme) thus fulfills the desired function, i.e. a constant print quality, permanently only if the setting (pressure) is correct. Too low a setting leads to the non-uniform transport of ink or dampening solution, because of the tolerances of circular running and cylindricity. Too high a setting has a detrimental effect on the service life of the cylinder surface, because of the internal friction and pressure overload.

In conjunction with this, a problem arises for quality assurance from the demand for ever higher productivity, and as a result of the efforts to produce printing-forme cylinders which are as light and cost-effective as possible. Especially what is referred to as channel-less printing, in particular therefore the sleeve technique which is distinguished by a printing forme applied without a seam onto a sleeve or a printing plate which is welded by laser to give a round shape, allows the rigidity to be reduced because of the lessened oscillation excitation as a result of the missing cylinder channels. As a result, the length-to-thickness ratio of the impression cylinders, or their relative rigidity with regard to deflection, becomes ever more unfavorable. The consequence of this is that, during printing operation, the shape and position of the impression cylinders with respect to one another change in an undesired manner, i.e. the impression cylinders are deflected.

Even when conventional plate cylinders are used, however, the impression-cylinder contour is pressed into the rubber blanket and the associated surface loading causes the cylinders to deflect, which leads to higher edge loading and to considerably lower loading in the center of the cylinders.

It is not possible to compensate for this lower loading in the cylinder center by increased cylinder pressure, because the edge zones would primarily profit from this and the central zones would only profit to a lesser extent.

The positional change as a consequence of a deflection changes the printing pressure, i.e. the setting pressure between the impression cylinders interacting in the printing unit, the pressure becoming non-uniform as seen across the cylinder width. This printing pressure is usually determined in numerical values by measuring what is referred to as the imprint width, i.e. the width of the zone which defines the contact area of the cylinders when the cylinders are thrown onto one another, i.e. moved to the pressure position. This measurement is particularly simple in offset printing, since here one cylinder of a pair of cylinders always has a compressible (soft) surface.

The printing or transfer characteristic curve, i.e. the tonal value gain, then depends directly on this imprint width, an increased imprint width meaning an increased tonal value gain and vice versa. The effect described therefore leads to a printing characteristic curve which changes in an undesired manner as viewed across the cylinder width.

In order to stabilize these printing characteristic curve values that vary across the cylinder width, previously either an appropriate support has been placed under the rubber blanket or, for example in the above-described DE 44 36 973 A1, the profile of the rubber blanket, i.e. its thickness, has been varied by the circumferential surface, in the axial direction of the cylinder, assuming a convex or concave shape on the blanket cylinder. Although the deflection between a blanket cylinder and a plate or forme cylinder can be compensated for by a convex profile of the blanket-cylinder surface, the contact is impaired, on the other hand, between the two blanket cylinders in a printing unit for recto and verso printing. This has a negative influence on both the web transport and the ink transfer to the paper web. Although the contact between the two blanket cylinders in the press nip is improved by a concave blanket-cylinder surface, the ink transfer from the forme cylinder to the blanket cylinder is then impaired.

SUMMARY OF THE INVENTION

Proceeding from this, it is the object of the present invention to make quality assurance in rotary printing possible, for a forme cylinder of a rotary printing press, in particular of an offset printing press, with regard to the printing or transfer characteristic curves, which quality assurance compensates for positional changes as a result of a deflection.

According to the invention, a forme cylinder for a rotary offset press has an axis and a substantially cylindrical circumferential surface for accommodating a printing forme, the cylinder having an axial center and opposed axial ends, the surface being convexly curved, as determined by calculation, so that the diameter of the forme cylinder is greatest in the axial center and smallest at the axial ends.

The line force differences between the printing edge and the printing center in the contact between the blanket cylinder and the plate cylinder can be considerably reduced by the circumferential surface which is convexly configured in the axial direction of the cylinder, i.e. by the "camber" of the forme cylinder. It is thus ensured that ink is constantly transferred from the plate cylinder to the blanket cylinder and from the blanket cylinder onto the paper web.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 4B:
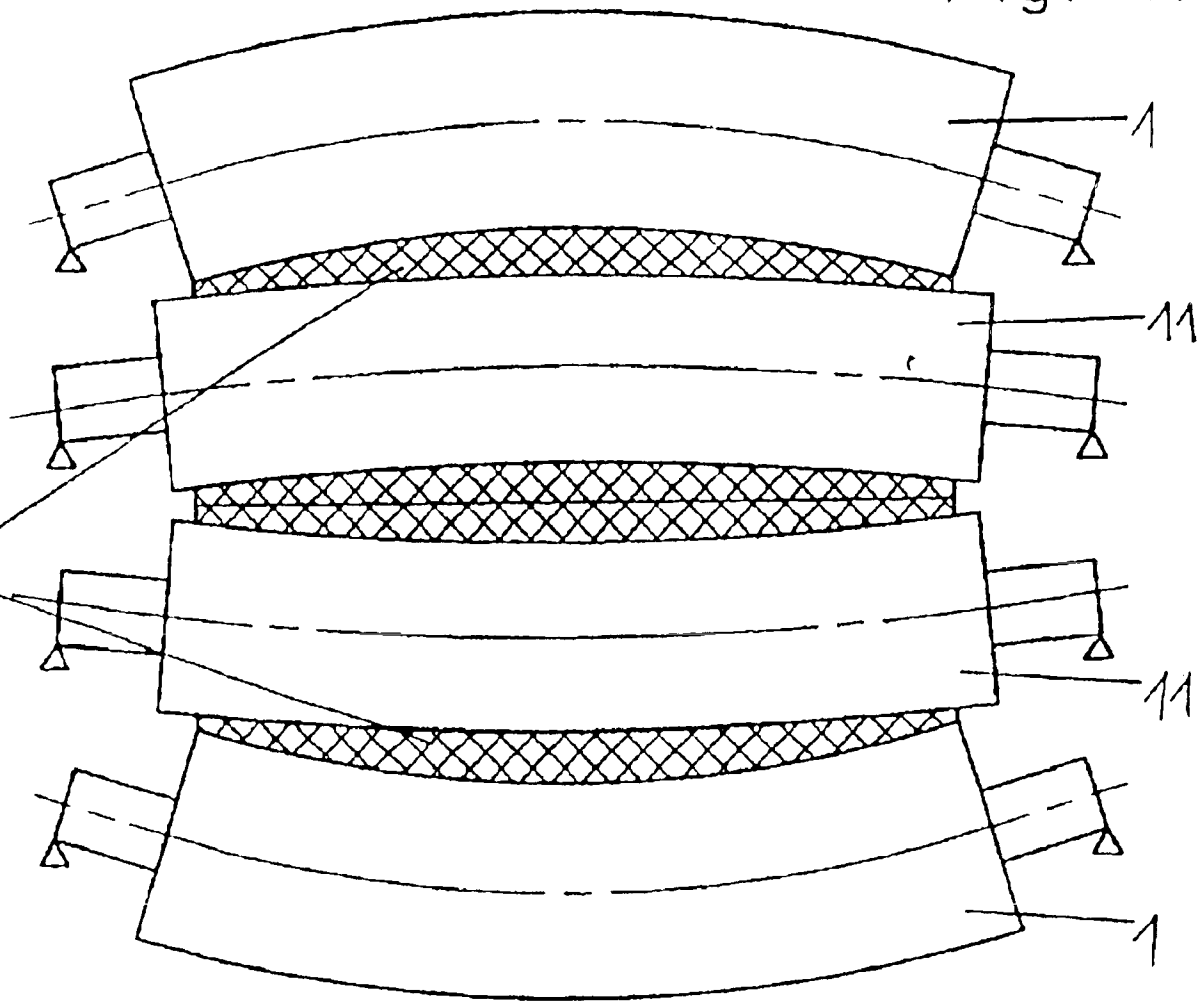
FIG. 4*b* shows the situation of the positional changes of the cylinders of a printing press according to FIG. 4*a* without the measures according to the invention.
Figure 4A:
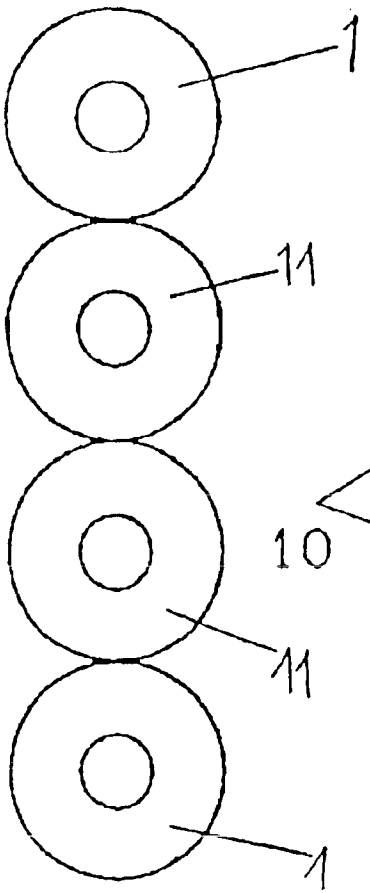
FIG. 4*a* shows a schematic printing-unit side view of an offset press for recto and verso printing.

FIG. 4*b* shows the undesirable positional changes (deflection) with respect to one another of the two forme cylinders 1 of an offset printing unit for recto and verso printing from FIG. 4*a* during printing operation. The setting pressure becomes non-uniform across the cylinder width, i.e. a line pressure is created which becomes non-uniform across the cylinder width. In wide presses, the forme cylinders of a rotary press, in particular of an offset press, bend in the printing center as a result of the reaction forces of the rubber blankets or rubber sleeves 10. Here, the blanket cylinders 11 bend somewhat less than the forme cylinders 1, as they are supported by the forme cylinders 1. The impression-cylinder contour is pressed here into the rubber blanket, and the associated surface loading causes the cylinders to deflect, which leads to higher edge loading and to considerably lower loading in the center of the cylinders.

The deflection of the printing-forme carrier can be determined on the basis of theoretical calculations using known material parameters and surface and line forces, for example also by finite element calculation.

Figure 1:
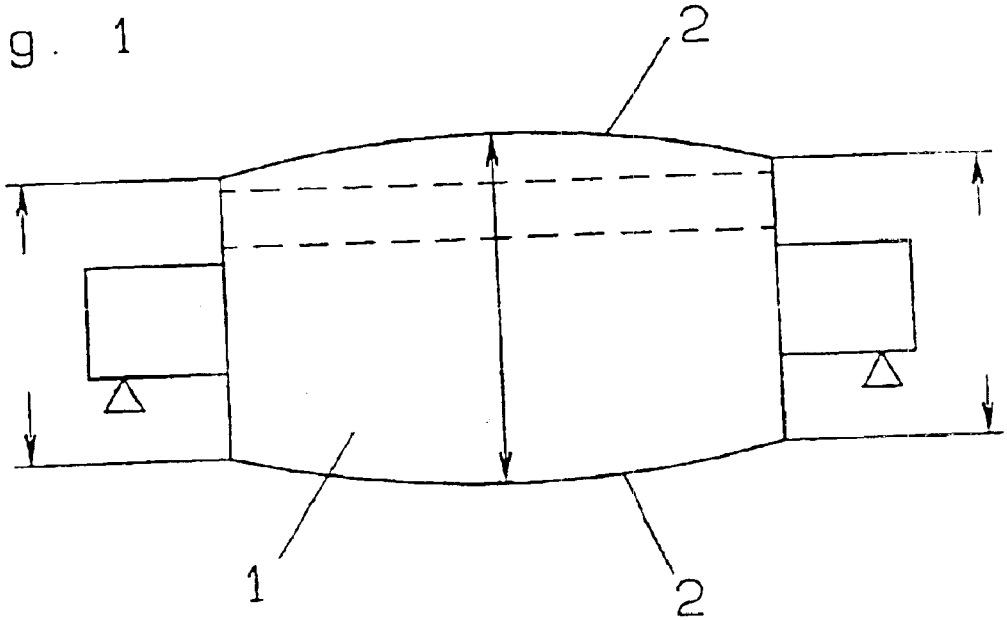
FIG. 1 shows a schematic longitudinal section through a forme cylinder according to the invention of a rotary press, in particular of an offset press.

According to FIG. 1, the surface 2 of the circumferential area of the forme cylinder 1 is produced with a convex profile, which has been determined empirically or, as previously indicated, by calculation, all the way round in the circumferential direction, i.e. it is designed to be cambered. The curved shape of the camber of the cylinder surface 2 can be a circular arc or an at least second-order parabola. That is to say, the convex profile of the circumferential surface 2 is varied in the axial direction, such that the diameter of the forme cylinders 1 is largest in the axial center and smallest at the axial ends.

Figure 2:
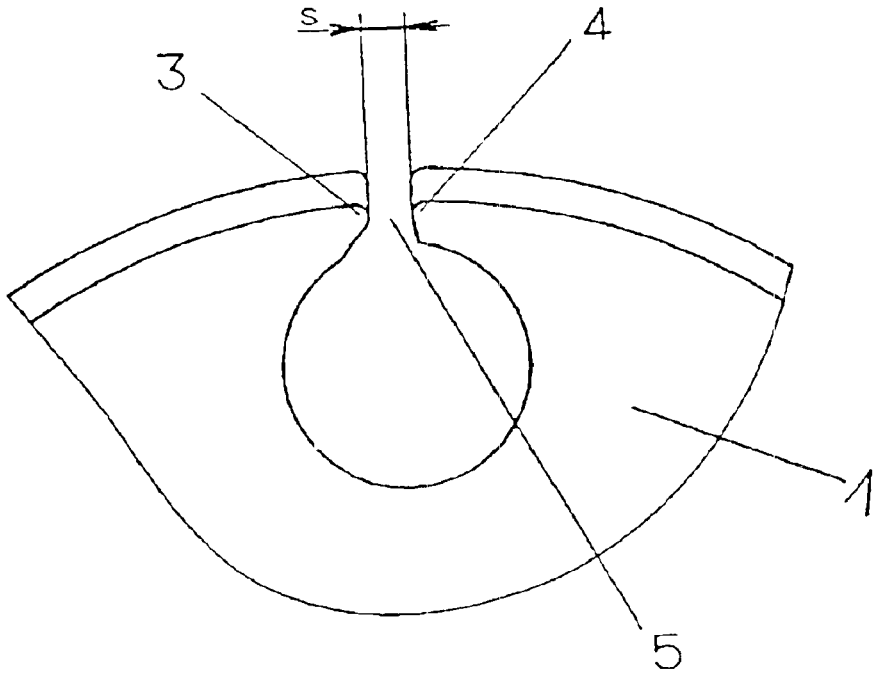
FIG. 2 shows a partial section through a plate cylinder of a rotary press, in particular of an offset press, having a cylinder channel for fixing a printing plate.

If the printing forme used is a printing plate that has to be fixed in a cylinder channel 5 of a plate cylinder 1, FIG. 2 shows that the transitions 3, 4 (radii) of the cylinder channel 5 along the cambered cylinder surface 2 are appropriately configured, such that the channel width "s" remains constant over the axial length of the cylinder channel 5.

Figure 3A:
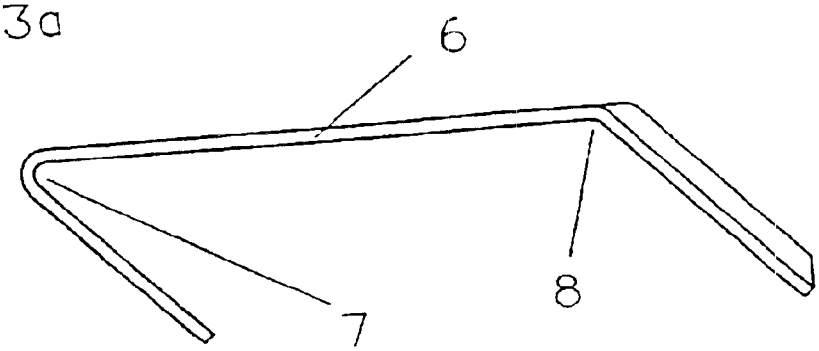
FIG. 3*a* shows a schematic view of a printing plate, as provided for a plate cylinder according to the invention.
Figure 3B:
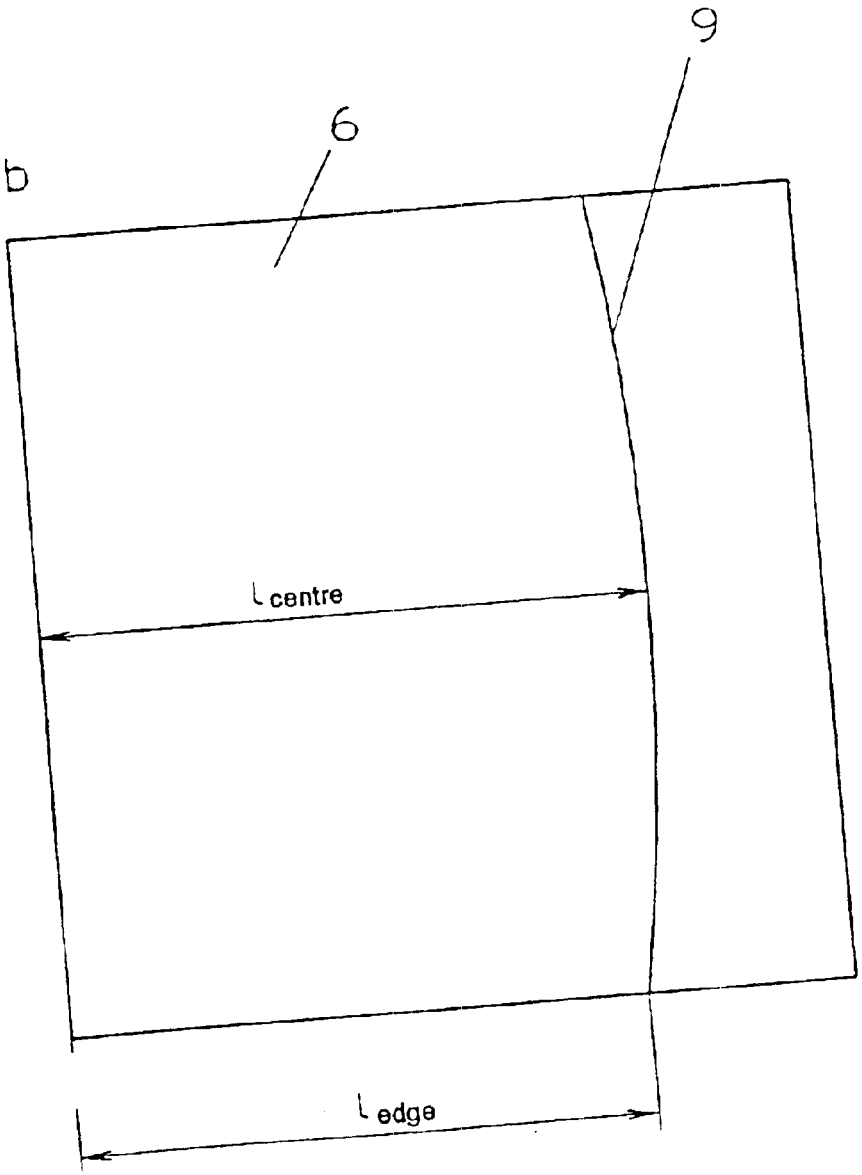
FIG. 3*b* shows the printing plate according to FIG. 3*a* in the unrolled state.

According to FIG. 3*a*, a printing plate 6 to be used in the case of a plate cylinder according to FIG. 2 is configured such that the bending length of the leading printing-plate radius 7 and trailing printing-plate radius 8 is bent to a greater extent in the printing center $I_{center}$, as shown in FIG. 3*b*, than at the printing edges, so that the length at the printing edges $I_{edge}$ is shorter than the length in the center $I_{center}$.

The trailing printing-plate radius 8 thus describes a curved shape 9 which has to harmonize with the curved shape 2 of the surface of the plate cylinder 1.

Figure 5:
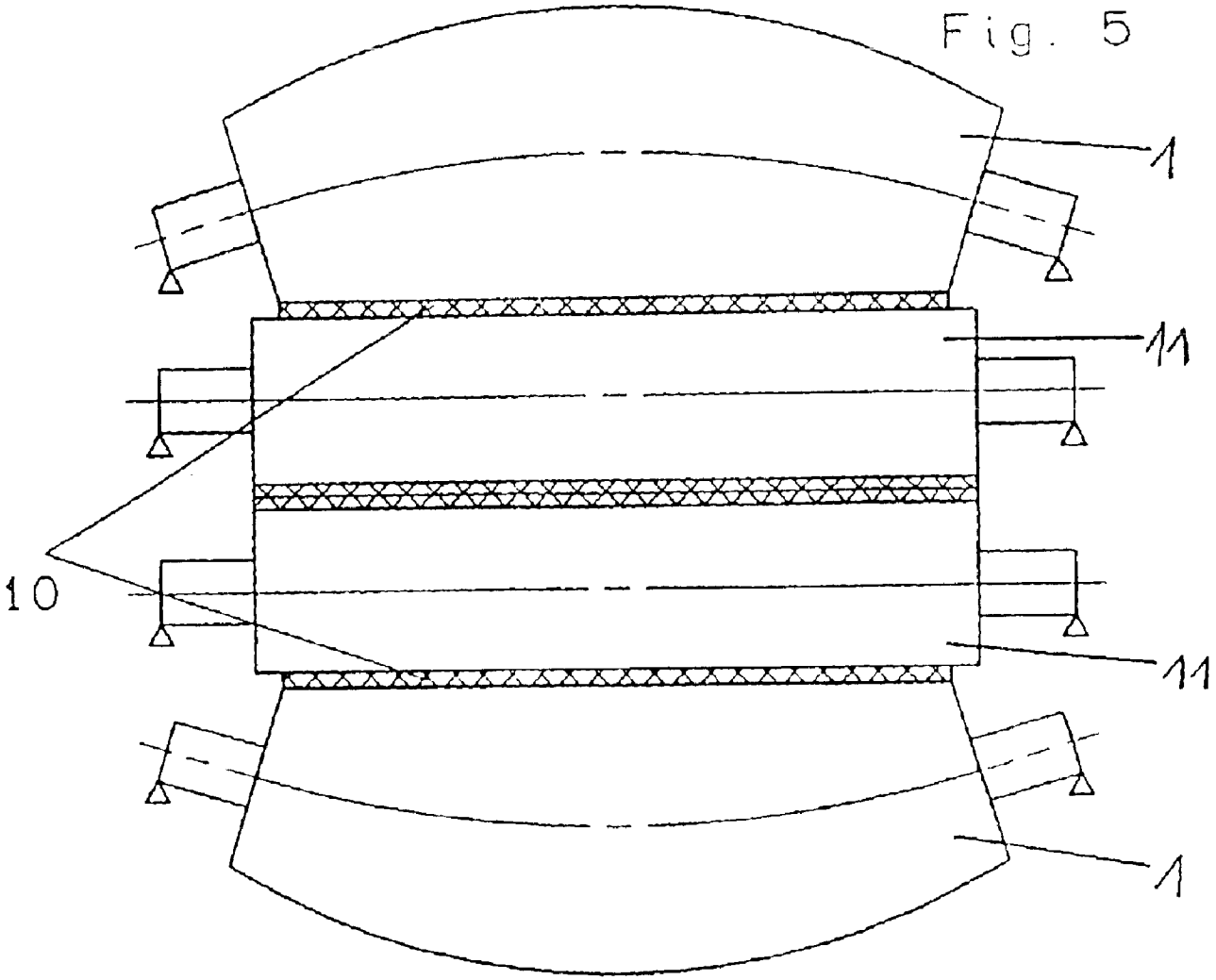
FIG. 5 shows the situation in the event of compensated positional changes of the cylinders according to FIG. 4*b* using the measures according to the invention.

In the case of a printing-press concept having two blanket cylinders thrown onto one another for recto and verso printing, as indicated in FIGS. 4*a*, 4*b*, it is, of course, possible to provide the configuration according to the invention in the case of forme cylinders according to FIG. 5.

As can, furthermore, be seen in FIG. 5 compared with FIG. 4*b*, the cambered configuration according to the invention of the surface of a forme cylinder 1 by means of a circumferential surface 2 which is convexly curved in the axial direction not only improves the contact between the blanket cylinder 11 and the forme cylinder 10, but likewise has a positive influence on the contact between the two blanket cylinders 11.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A forme cylinder for a rotary offset press, said cylinder comprising an axis and a substantially cylindrical circumferential surface for accommodating a printing forme, said cylinder having an axial center and opposed axial ends, said surface being convexly curved so that the diameter of the forme cylinder is greatest in the axial center and smallest at the axial ends, wherein said forme cylinder is a plate cylinder having a cylinder channel extending along said circumferential surface, said channel having a pair of opposed overhangs defining a channel width which is constant over the axial length of said channel.

2. A forme cylinder as in claim 1 wherein said circumferential surface has a profile which describes a circular arc.

3. A forme cylinder as a in claim 1 wherein said circumferential surface has a profile which describes a second order parabola.

4. A forme cylinder as in claim 1 further comprising a printing plate having a leading printing plate radius, a trailing printing plate radius, a pair of printing edges having an edge length extending between said radii, and a center having a center length extending between said radii centrally of said edges, said trailing radius being bent along an arc so that said center length is greater than said edge length.

5. An offset rotary printing press comprising:

a pair of blanket cylinders set against one another for recto and verso printing; and a pair of forme cylinders set against respective said blanket cylinders, said forme cylinders each comprising an axis and a substantially cylindrical circumferential surface for accommodating a printing forme, each said forme cylinder having an axial center and opposed axial ends, said surface being convexly curved so that the diameter of the forme cylinder is greatest in the axial center and smallest at the axial ends.

* * * * *